United States Patent [19]

Badham

[11] 3,944,165

[45] Mar. 16, 1976

[54] DISPENSER FOR THREADED MATERIAL

[76] Inventor: Rose A. Badham, 2720 Oroville-Quincy Road, Oroville, Calif. 95965

[22] Filed: Apr. 4, 1974

[21] Appl. No.: 457,930

[52] U.S. Cl. ..... 242/136; 242/137.1; 242/146

[51] Int. Cl.[2] ..... B65H 49/18

[58] Field of Search ..... 242/118, 127, 137, 137.1, 242/141, 146, 159, 170, 171, 136; 206/223, 388; 223/106, 107; 66/1 A; 112/218 R, 218 A

[56] References Cited

UNITED STATES PATENTS

| | | | |
|---|---|---|---|
| 1,390,982 | 9/1921 | Christensen | 242/136 |
| 2,827,247 | 3/1958 | Kraemer | 242/127 |
| 2,940,683 | 1/1960 | Tauber et al. | 242/127 |
| 3,335,847 | 8/1967 | Murphy et al. | 206/223 |
| 3,352,412 | 11/1967 | Draving et al. | 242/137.1 |
| 3,833,183 | 9/1974 | Swatzell, Sr. | 242/127 |

FOREIGN PATENTS OR APPLICATIONS

| | | | |
|---|---|---|---|
| 908,396 | 10/1962 | United Kingdom | 242/146 |

*Primary Examiner*—Leonard D. Christian
*Attorney, Agent, or Firm*—Ernest L. Brown

[57] ABSTRACT

A threaded material dispenser having first and second substantially identical contoured members, hinged together to fold into overlapping position with said second member supported by said first member; each member preferably being pliable and having a depressed central region surrounded on at least three sides by raised portions, so that at least one skein of yarn positioned between said members in the central region thereof may be dispensed between said raised portion of said two members without pulling out the skein of yarn, said raised portions and the walls of one of said central regions preferably enclosing granulated material.

8 Claims, 3 Drawing Figures

DISPENSER FOR THREADED MATERIAL

BACKGROUND OF THE INVENTION

It is desirable to have a dispenser of threaded material which is particularly adapted to store and hold a skein of yarn while allowing yarn to be withdrawn, keeping the right tension on the yarn to allow a single strand to be withdrawn.

PRIOR ART

U.S. Pat. No. 2,827,247 pertains to a container having a plurality of pegs upon which the yarn is wound and from which it is dispensed.

U.S. Pat. No. 2,940,683 pertains to an embroidery thread holder having a rack for holding threads of different colors and for dispensing the threads without tangling.

U.S. Pat. No. 3,335,847 pertains to a brief case type structure including storage trays having shaped storage cavities for storing knitting needles and the like.

U.S. Pat. No. 3,833,183 pertains to a rack for pegs, the pegs being positioned and biased to hold yarn in tension when wound around a pair of said pegs.

BRIEF DESCRIPTION OF THE INVENTION

The apparatus contemplated by this invention is described herein as a yarn dispenser. Obviously other threaded material may be dispensed, and the claims reflect that concept.

The apparatus, in its preferred embodiment, comprises two substantially identical cloth or plastics members filled with granular material such as, for example beans, rice and bird seed. The members are preferably substantially oval in plan view, and they are hinged together at one end so that a second member may be folded over a first member. The first or bottom member has a depressed central region surrounded by raised portions. The members are preferably pliable, and the central portions are preferably made of two overlapping sheets of material. Granular material is placed between the two sheets of the second or upper member so that when a skein of yarn sits in the central region of the first member, the weight of the granular material causes the center portion of the upper or second member to sag onto the enclosed yarn skein, braking it against moving. Thread from the enclosed yarn skein is threaded between the abutting raised portions of the members. The abutting raised portions are also made of yielding material and filled with granular material to allow single strands of yarn to be pulled from the yarn skein.

In one preferred embodiment, the invention may be characterized as an oval-shaped, fabric bean-bag cradle that beds a skein of yarn, snuggles over, under and around the skein of yarn, keeping it securely in place. The central portion of the second or upper member of the invention preferably settles with the yarn skein as yarn is used, keeping the right amount of pressure on the yarn to prevent the yarn skein from flip-flopping out of control. The item stores and protects yarn and keeps items together when they are not in use. It may have handles for carrying.

It is therefore an object of this invention to store and hold a storage member of threaded material.

It is a more specific object of this invention to hold at least one skein of yarn and to dispense a single strand from each held skein.

BRIEF DESCRIPTION OF THE DRAWINGS

Other objects will become apparent from the following description taken together with the accompanying drawings in which.

DETAILED DESCRIPTION OF THE INVENTION

The apparatus of this invention is for dispensing threaded material. It is obvious that the threaded material need not be yarn, and that it may be upon another type of storage member than a skein.

Figure 1:
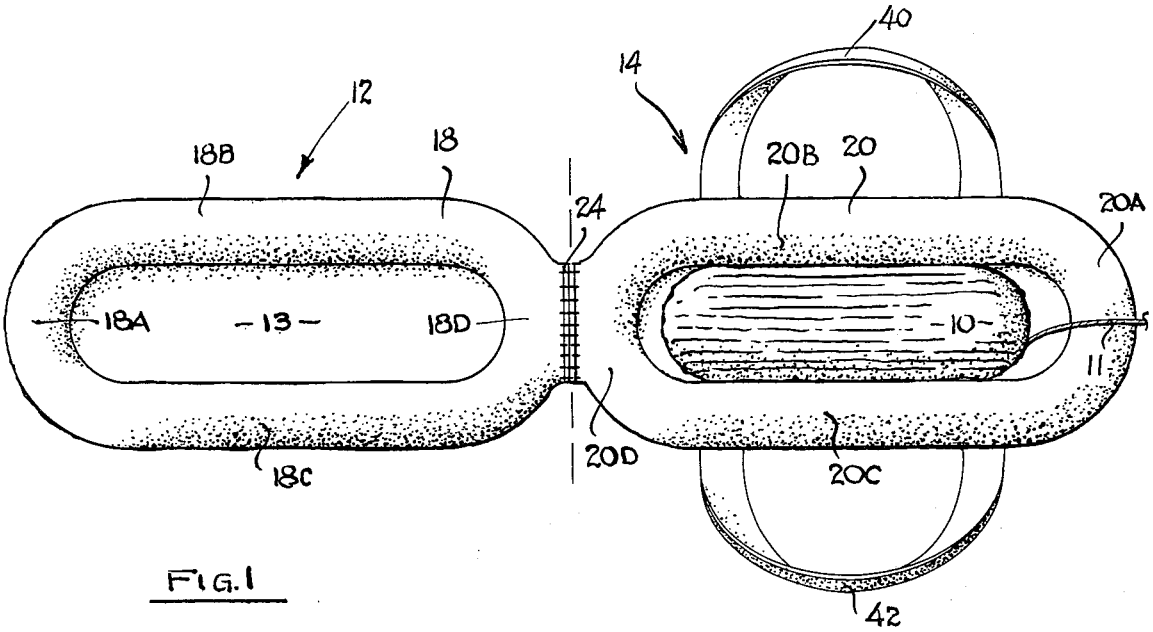
FIG. 1 shows the apparatus of this invention in an unfolded view.
Figure 2:
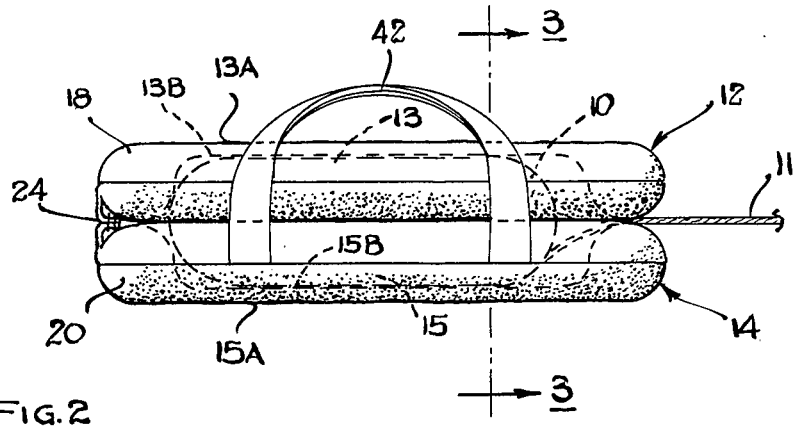
FIG. 2 shows the apparatus of the invention in a folded view.
Figure 3:
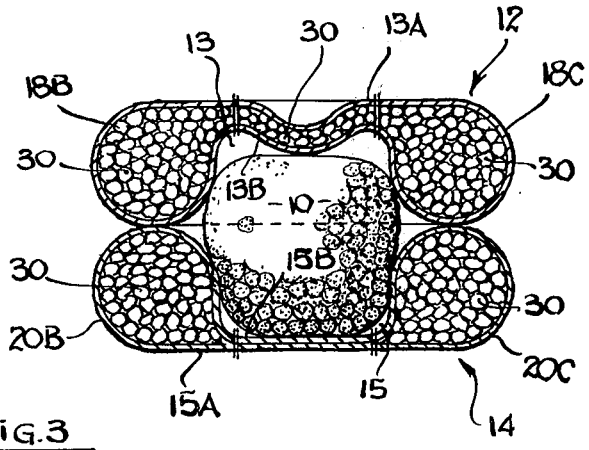
FIG. 3 is a sectional view taken at 3—3 in FIG. 2.

The apparatus comprises first and second contoured members 12 and 14. Each contoured member 12, 14 has a central region 13, 15 respectively, surrounded on at least first, second and third sides by raised portions 18, 20 respectively. The first, second, third and fourth sides of raised portions 18, 20 are designated 18A, 18B, 18C, 18D and 20A, 20B, 20C, 20D respectively. The raised portions 18 and 20 are preferably substantially identical to allow the raised portion 18 to sit upon the raised portion 20 as shown in FIGS. 2 and 3.

The regions 13 and 15 are sufficiently large to hold at least one storage member 10 of threaded material. It is obvious, however, that if one wanted to hold more than one storage member, the regions 13 and 15 could be made larger.

Threaded material is dispensed, as shown at 11, from the yarn skein 10 between the overlapping sides 18A and 20A of the raised portions 18, 20. Notice that it could be dispensed between 18B/20B, between 18C /20C, and between 18D /20D of portions 18 and 20.

With dispensing between 18A/20A, it is preferable that sides 18B, 18C, 20B, 20C be present so that pulling on thread strand 11 does not pull the yarn skein 10 out of the central depression. In a most preferred embodiment the sides 18D and 20D are also present, and the enclosures 13, 15 are completely surrounded by raised portions 18, 20.

Preferably the two contoured members 12, 14 are hinged by a hinge 24 so that member 12 may be folded over member 14.

In the most preferred embodiment the entire dispenser is made of pliable material such as cloth or plastic material sheets 15A, 15B, and except for the region between is filled with granular material such as beans, rice, bird seed or polished sand. Sharp granular material is not desirable because it may tear the cloth. Note, however, that such sharp granular material is within the scope of the invention.

Note also that in the shown embodiment the walls of the central portions are each a pair of overlapping sheets, 13A, 13B and 15A, 15B. Between 13A and 13B is granular material 30. Optionally, granular material may be between sheets 15A, 15B. (not shown)

The raised portions 18, 20 are shown as substantially circularly cylindrical tubular members 18A, 18B, 18C, 18D and 20A, 20B, 20C, 20D filled with granular material 30.

It is desirable that the central portion walls 13A, 13B, 15A, 15B be sufficiently pliable that the weight of the enclosed granular material between 13A, 13B causes the walls to sag and snuggle around the yarn skein 10 as it becomes smaller, producing a braking action to prevent inadvertent unwinding and tangling of the yarn.

The shown oval plan with raised portions 18, 20 lineally surrounding the central regions 13, 15 is preferred.

It is also preferred to include handles 40, 42 attached to the sides 20B and 20C of bottom member 14.

Preferably each member 10, 12 is fabricated from two overlapping sheets of material with seams separating the central from the outside regions.

Although the invention has been described in detail above, it is not intended that the invention shall be limited by the specification but only by the claims as interpreted by the specification.

I claim:

1. A threaded material dispenser comprising:

first and second contoured members, each said member having an oval plan and a depressed central region lineally surrounded by raised portions, said raised portions being substantially identical on said two members to allow the said raised portion said second member to sit on the said raised portion of said first member, said members being hinged together on one side thereof;

said dispenser being made of pliable material, and at least said raised portions being filled with granular material;

the space formed between said overlapping central regions being of sufficient size to hold at least one storage member of threaded material;

whereby threaded material may be dispensed from said storage member between at least one side of said raised portions of said first and second members.

2. The dispenser of claim 1 in which said central portions each comprise a pair of overlapping sheets of pliable material; and granular material between said sheets of said second member.

3. The dispenser of claim 2 in which said raised portions comprise substantially circularly cylindrical tubes surrounding their respective central portions.

4. The dispenser of claim 3 in which said pliable material is selected from the class consisting of cloth or plastic material and said granular material is selected from the class consisting of beans, rice or seed.

5. A threaded material dispenser comprising:

first and second contoured members, each said member having a depressed central region surrounded on at least first, second and third sides by a raised portion;

said raised portions being substantially identical on said two members to allow the said raised portion of said second member to sit on the said raised portion of said first member;

the space formed between said overlapping central regions being of sufficient size to hold at least one storage member of threaded material;

said central portion of at least said second member being sufficiently pliable and heavy that it sags of its own weight, whereby it rest upon said storage member of threaded material;

whereby threaded material may be dispensed from said storage member between at least one side of said raised portions of said first and second members.

6. The dispenser of claim 5 in which said raised portions are sufficiently pliable to allow a strand of said threaded material to be pulled between said raised portion of said first and second members from at least one of said storage members of threaded material.

7. The dispenser of claim 6 in which there is only one said storage member.

8. The dispenser of claim 7 in which said threaded material is yarn, and said storage member is a skein of said yarn.

* * * * *